US008104659B2

(12) United States Patent
St. John et al.

(10) Patent No.: US 8,104,659 B2
(45) Date of Patent: Jan. 31, 2012

(54) ELECTROMAGNETIC STAPLER WITH A MANUALLY ADJUSTABLE DEPTH ADJUSTER

(75) Inventors: Robert St. John, Cheshire, CT (US); Thomas Pelletier, Wallingford, CT (US); Scott Fong, Brisbane (AU)

(73) Assignee: Stanley Black & Decker, Inc., New Britain, CT (US)

( * ) Notice: Subject to any disclaimer, the term of this patent is extended or adjusted under 35 U.S.C. 154(b) by 1107 days.

(21) Appl. No.: 11/389,296

(22) Filed: Mar. 27, 2006

(65) Prior Publication Data

US 2007/0221698 A1 Sep. 27, 2007

(51) Int. Cl.
*B25C 5/15* (2006.01)

(52) U.S. Cl. ..... 227/142; 227/131

(58) Field of Classification Search ..... 227/131, 227/142, 5–7, 8

See application file for complete search history.

(56) References Cited

U.S. PATENT DOCUMENTS

| | | | | |
|---|---|---|---|---|
| 3,055,344 | A | 9/1952 | Fisher | |
| 3,063,421 | A | 11/1962 | Fisher | |
| 3,345,546 | A | 10/1967 | Beltramo | |
| 3,347,438 | A | 10/1967 | Doherty | |
| 3,567,098 | A * | 3/1971 | Maynard | 227/5 |
| 3,589,587 | A * | 6/1971 | Manganaro | 227/131 |
| 4,005,812 | A * | 2/1977 | Doyle et al. | 227/131 |
| 4,030,656 | A | 6/1977 | Gordon | |
| 4,349,143 | A | 9/1982 | Ewig | |
| 4,417,681 | A * | 11/1983 | Bernecki et al. | 227/8 |
| 4,491,262 | A | 1/1985 | Ewig | |
| 4,492,880 | A | 1/1985 | Weiss | |
| 4,524,897 | A | 6/1985 | Bachmann | |
| 4,544,090 | A | 10/1985 | Warman et al. | 227/131 |
| 4,611,742 | A * | 9/1986 | Rieker et al. | 227/131 |
| 4,946,087 | A | 8/1990 | Wingert | |
| 5,074,453 | A | 12/1991 | Tachihara et al. | |
| 5,098,004 | A * | 3/1992 | Kerrigan | 227/134 |
| 5,219,110 | A | 6/1993 | Mukoyama | |
| 5,666,715 | A * | 9/1997 | Zoiss et al. | 29/566.4 |
| 5,715,982 | A * | 2/1998 | Adachi | 227/8 |
| 5,728,997 | A | 3/1998 | Kim et al. | 219/702 |
| 5,813,589 | A * | 9/1998 | Kim | 227/67 |
| 5,884,829 | A | 3/1999 | Wingert | |
| 5,897,043 | A * | 4/1999 | Veoukas et al. | 227/10 |
| 6,012,622 | A | 1/2000 | Weinger et al. | |

(Continued)

FOREIGN PATENT DOCUMENTS

| | | |
|---|---|---|
| DE | 950 480 | 10/1956 |

(Continued)

*Primary Examiner* — Lindsay Low

(74) *Attorney, Agent, or Firm* — Pillsbury Winthrop Shaw Pittman LLP

(57) ABSTRACT

An electromagnetic stapler includes a driver for driving fasteners into a workpiece, and a solenoid for providing power to the driver. The solenoid has a coil, and a core that is operatively connected to the driver. The stapler also includes a manually adjustable depth adjuster for adjusting a depth of drive of the fasteners. The depth adjuster is movable between a plurality of predefined positions, including a maximum depth of drive position, a minimum depth of drive position, and at least one intermediate depth of drive position. The depth adjuster includes a cam having a cam surface that interacts with the core so as to define an upper position of the core, an adjustment knob operatively connected to the cam, and a detent mechanism for securing the cam at one of the plurality of predefined positions to thereby define the upper position of the core.

21 Claims, 10 Drawing Sheets

U.S. PATENT DOCUMENTS

| | | | | |
|---|---|---|---|---|
| 6,176,412 | B1 | 1/2001 | Weinger et al. | |
| 6,186,386 | B1 * | 2/2001 | Canlas et al. | 227/142 |
| 6,216,935 | B1 | 4/2001 | Oussani, Jr. et al. | |
| 6,364,193 | B1 * | 4/2002 | Tsai | 227/131 |
| 6,481,608 | B2 | 11/2002 | Wohlwend et al. | |
| 6,675,999 | B2 | 1/2004 | Mukoyama et al. | |
| 6,695,192 | B1 | 2/2004 | Kwok | |
| 6,742,691 | B2 | 6/2004 | Chen | |
| 6,830,173 | B2 | 12/2004 | Barber et al. | |
| 6,883,696 | B1 | 4/2005 | Steinbrunner et al. | |
| 6,938,811 | B2 * | 9/2005 | Ehmig et al. | 227/10 |
| 2002/0185514 | A1 | 12/2002 | Adams et al. | |
| 2005/0040206 | A1 | 2/2005 | Adams et al. | |
| 2005/0184120 | A1 | 8/2005 | Terrell et al. | |

FOREIGN PATENT DOCUMENTS

| | | |
|---|---|---|
| DE | 27 54 641 | 6/1979 |
| DE | 195 17 781 | 9/1996 |
| DE | 103 23 544 | 12/2004 |

* cited by examiner

ELECTROMAGNETIC STAPLER WITH A MANUALLY ADJUSTABLE DEPTH ADJUSTER

BACKGROUND OF THE INVENTION

1. Field of the Invention

The present invention is generally related to a stapler for driving fasteners into a workpiece. More specifically, the present invention is related to an electromagnetic stapler that has a manually adjustable depth adjuster.

2. Description of Related Art

Electromagnetic staplers convert electricity into energy for driving fasteners, such as staples and small nails (e.g. brads), into workpieces. Electromagnetic staplers include a solenoid that is used to convert electricity into an electromagnetic force that is suitable for accelerating a driver to impact the fastener and drive the fastener into the workpiece.

Because different workpieces have different hardnesses, it is desirable to have the ability to control the amount of energy that is provided to the fastener so as to control the depth at which the fastener is driven. For example, more energy would be required to drive a fastener into a harder piece of wood than a softer piece of wood at the same depth of penetration. In addition, by having the ability to control the amount of energy that is provided to the fastener, fasteners with different sizes and shapes may be driven from the same stapler. For example, a staple with legs of one length will not have to be driven as deep as a staple with legs having a longer length. Although there have been staplers that allow for a relatively easy adjustment between a maximum depth of drive and a minimum depth of drive, such as disclosed in U.S. Pat. No. 4,491,262, hereby incorporated by reference, there haven't been staplers that allow for at least one easily adjustable, repeatable intermediate depth of drive.

BRIEF SUMMARY OF THE INVENTION

According to an aspect of embodiments of the invention, an electromagnetic stapler is provided. The stapler includes a housing, a driver within the housing for driving fasteners into a workpiece, a magazine for feeding the fasteners to be driven by the driver, and a solenoid for providing power to the driver. The solenoid has a coil, and a core. The core is operatively connected to the driver. The stapler also includes a manually adjustable depth adjuster for adjusting a depth of drive of the fasteners. The depth adjuster is movable between a plurality of predefined positions, including a maximum depth of drive position, a minimum depth of drive position, and at least one intermediate depth of drive position. The depth adjuster includes a cam having a cam surface that interacts with the core of the solenoid so as to define an upper position of the core, an adjustment knob operatively connected to the cam such that movement of the adjustment knob causes corresponding movement of the cam, and a detent mechanism for securing the cam at one of the plurality of predefined positions to thereby define the upper position of the core so as to establish the length of an axial stroke of the driver.

According to an aspect of embodiments of the invention, a manually adjustable depth adjuster for adjusting a depth of drive of a fastener using an electromagnetic stapler having a housing, a driver, and a solenoid for providing power to the driver is provided. The depth adjuster includes a cam having a cam surface that interacts with a core of the solenoid so as to define an upper position of the core, an adjustment knob operatively connected to the cam such that movement of the adjustment knob causes corresponding movement of the cam, and a detent mechanism for securing the cam at one of the plurality of predefined positions to thereby define the upper position of the core so as to establish the length of an axial stroke of the driver.

These and other aspects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

Embodiments of the invention will now be described, by way of example only, with reference to the accompanying schematic drawings, in which corresponding reference symbols indicate corresponding parts, and in which.

DETAILED DESCRIPTION OF THE INVENTION

Figure 1:
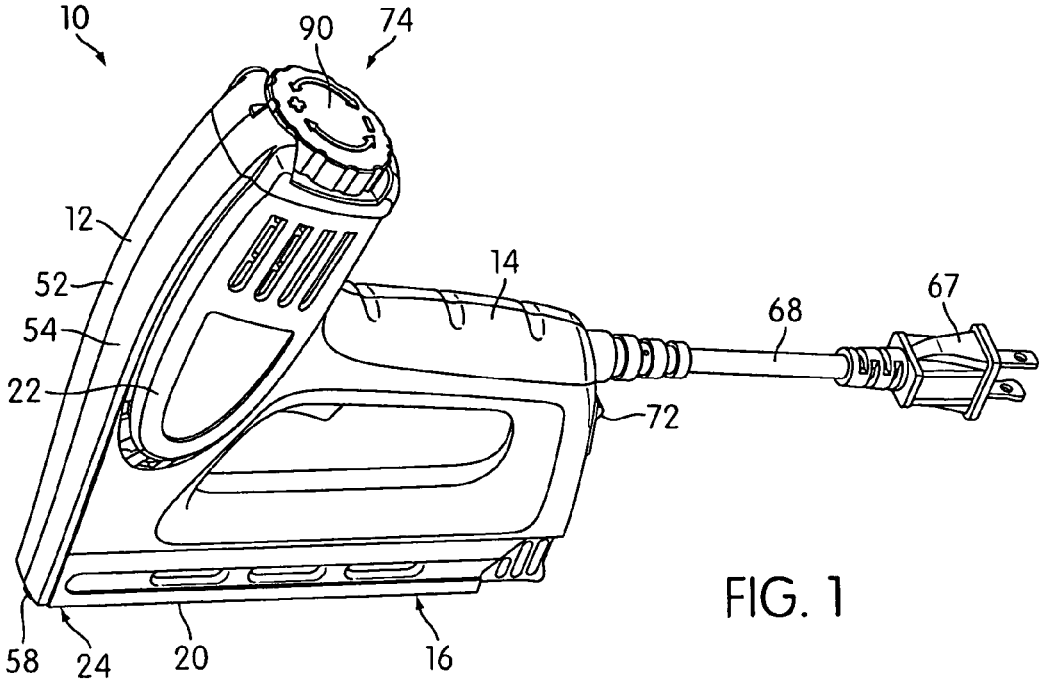
FIG. 1 is a perspective view of a stapler according to embodiments of the present invention.
Figure 2:
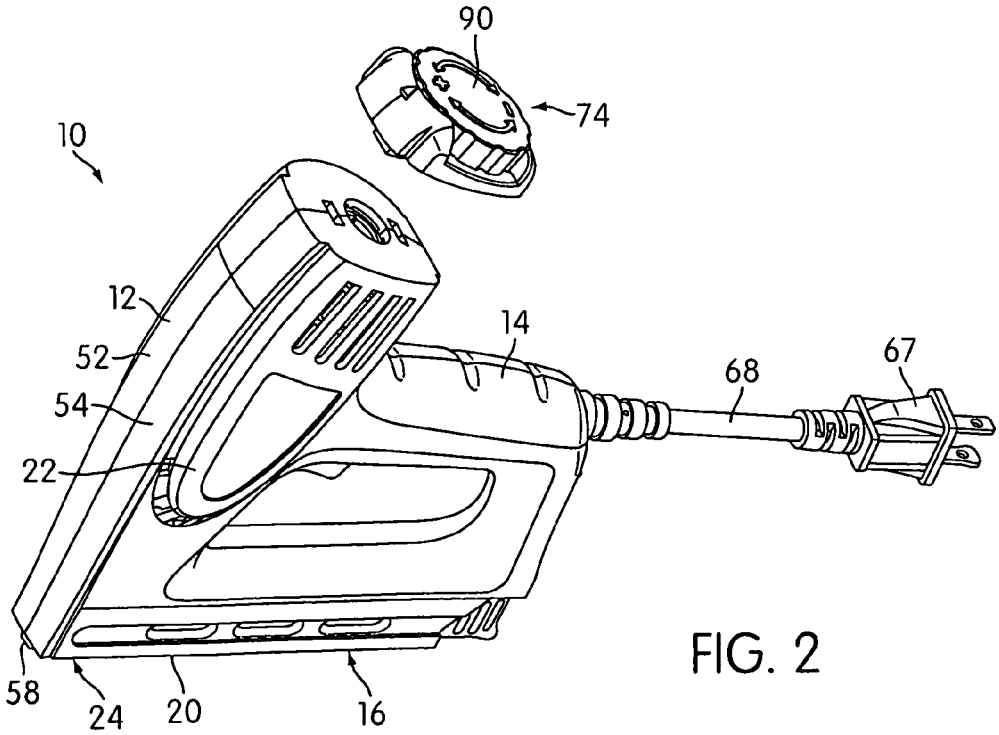
FIG. 2 is an exploded perspective view of the stapler of FIG. 1, with a manually adjustable depth adjuster separated from the remaining portion of the stapler.

FIG. 1 shows a stapler 10 according to at least one embodiment of the present invention. The stapler 10 includes a housing 12 that is configured to be carried by a user via a handle portion 14 of the housing 12. Connected to, or integral with, the housing 12 is a magazine 16 for carrying a supply of fasteners 18 to be driven into a workpiece (not shown). The magazine 16 includes a substantially flat bottom surface 20 that is configured to be placed on the workpiece. The housing 12 also includes a body portion 22 that extends upwardly from a forward end 24 of the magazine 16 so as to define a drive track 25 (shown in FIGS. 4-7).

Figure 5:
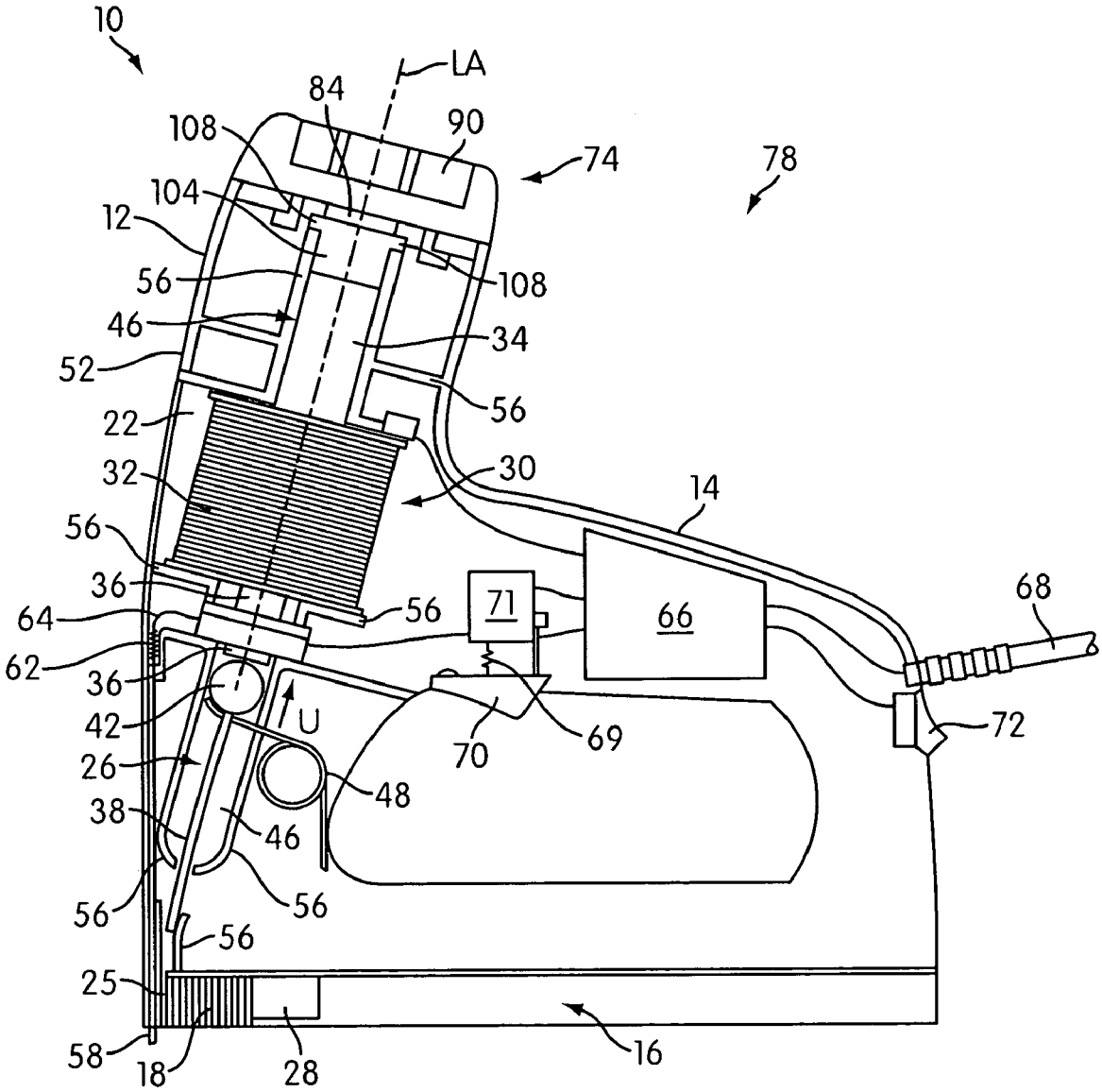
FIG. 5 is a side view of the stapler of FIG. 1 with one half of the housing removed and the adjustable depth adjuster in a maximum depth of drive position.
Figure 6:
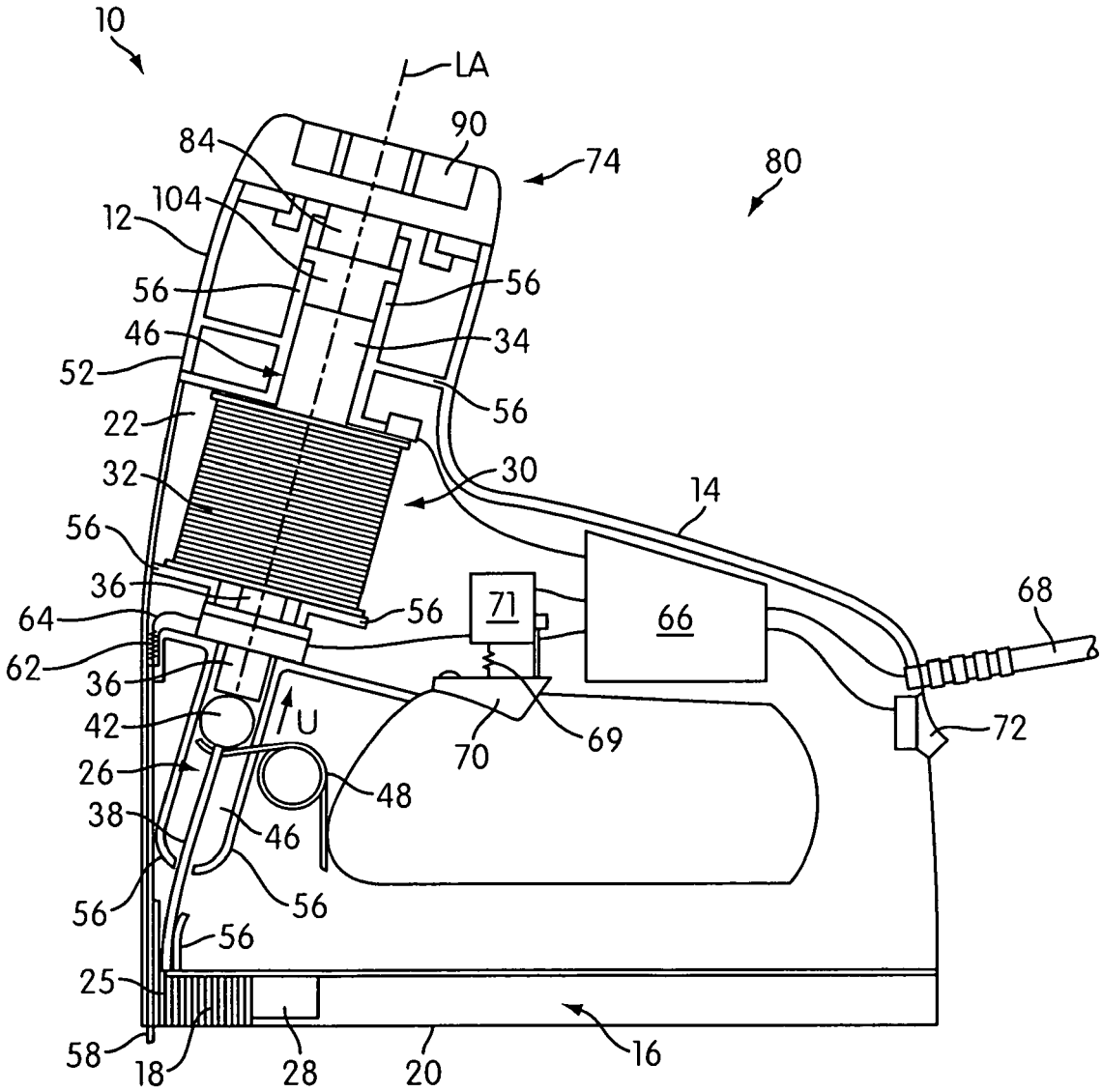
FIG. 6 is a side view of the stapler of FIG. 5 with the adjustable depth adjuster in a minimum depth of drive position.
Figure 7:
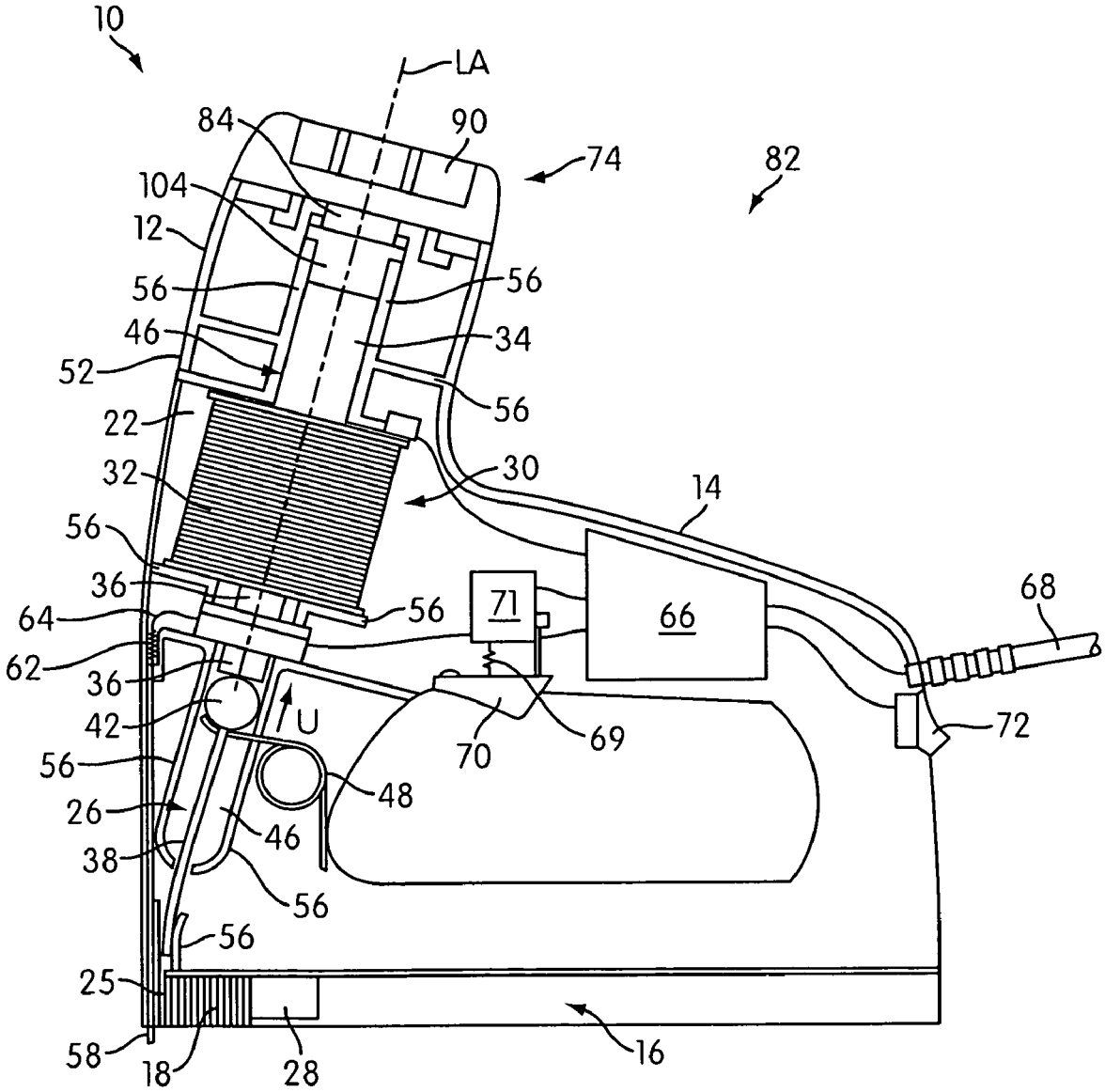
FIG. 7 is a side view of the stapler of FIG. 6 with the adjustable depth adjuster in an intermediate depth of drive position

As shown in FIGS. 5-7, a driver 26 that is configured to drive the fasteners 18 out of the drive track 25 and into the workpiece is disposed within the body portion 22 of the housing 12. The driver 26 is constructed and arranged to be reciprocally moveable within the housing 12 so as to drive successive fasteners 18 from the magazine 16 into the workpiece.

The magazine 16 is constructed and arranged to accommodate different types of fasteners 18. For example, the magazine 16 is configured to accept both staples and nails. A spring-biased pusher 28 is slidably received by the magazine 16 to urge the fasteners 18 that have been loaded into the magazine 16 towards the drive track 25 so that the fasteners 18 may be driven by the driver 26, one at a time, into the workpiece.

A solenoid 30 is provided in the body portion 22 of the housing 12. Preferably, the solenoid 30 has a single coil 32, and a core 34 that is configured to reciprocate within the coil 32 in response to electrical energization of the coil 32. As shown in the Figures, the core 34 has a plunger 36 that is co-axially fixed thereto and extends downwardly therefrom so that the core 34 and the plunger 36 reciprocate as a single unit along a substantially straight path. The plunger 36 is configured to interact with the driver 26 such that downward movement of the plunger 36 toward the drive track 25 causes movement of the driver 26 into the drive track 25.

The driver 26 includes a plate 38 that is substantially rectangular in shape and has a thin cross-section. As shown in the figures, the plate 38 is slightly bent so that it may travel along a curved path. This allows the driver 26 and the plunger 36 of the solenoid 30 to be disposed at an angle relative to the drive track 25. The driver 26 also includes at one end, which may be referred to as a proximal end 40, a cylinder 42 that is configured to interact with the plunger 36 of the solenoid 30. A distal end 44 of the driver 26 is configured to engage the leading fastener 18 to be driven into the workpiece.

Figure 4:
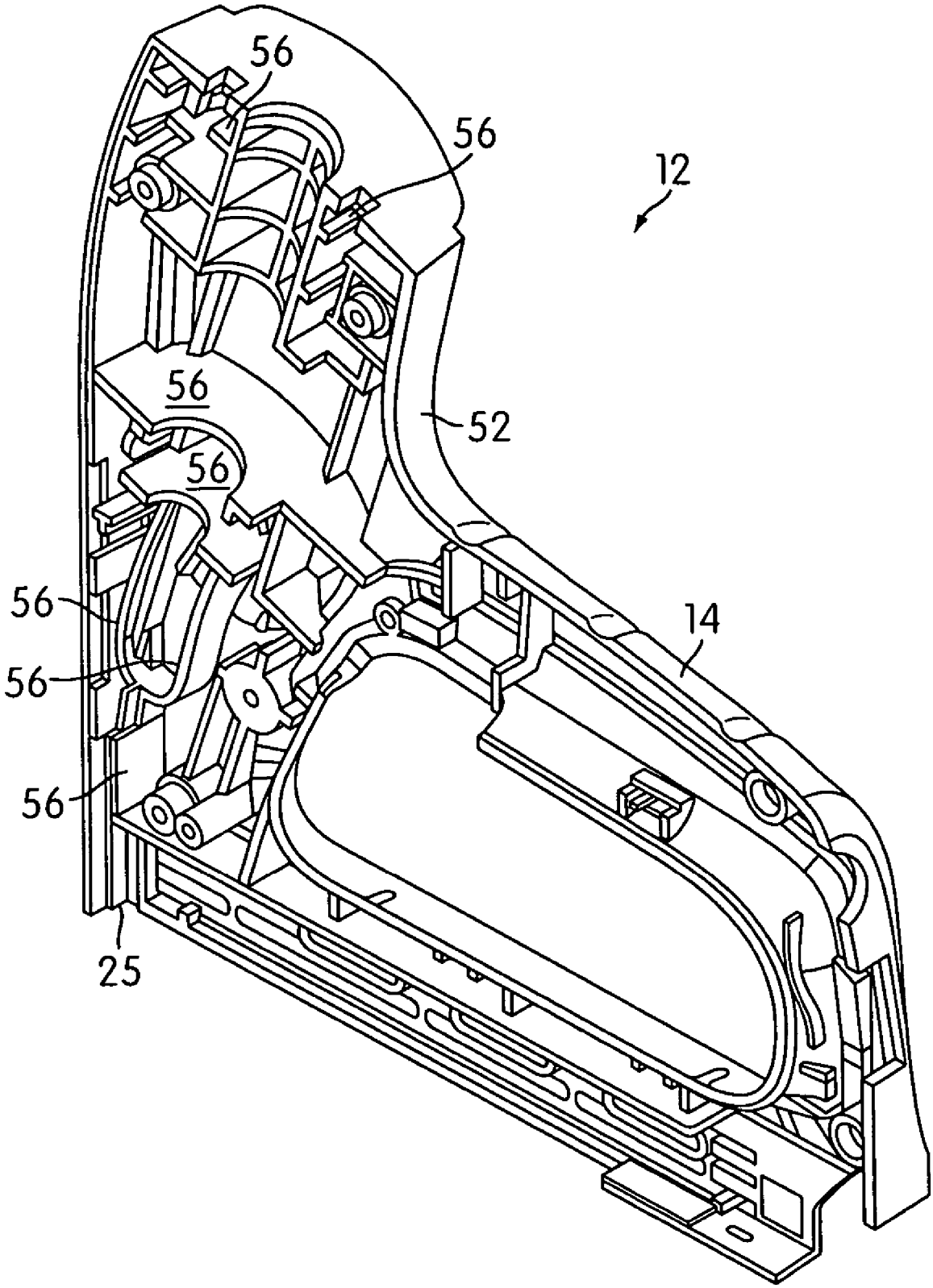
FIG. 4 is a perspective view of one half of a housing of the stapler of FIG. 1.

The housing 12 includes two halves 52, 54 that are substantially mirror-images of each other. One of the halves 52 is illustrated in FIG. 4. As shown in FIG. 4, the housing 12 includes a plurality of ribs 56 that define a plurality of compartments for housing many of the internal components, such as the solenoid 30, of the stapler 10. The ribs 56 also define a plurality of passageways, including a curved passageway 46, in which the movable parts of the stapler 10, such as the driver 26 and the plunger 34, may reciprocate.

Figure 3:
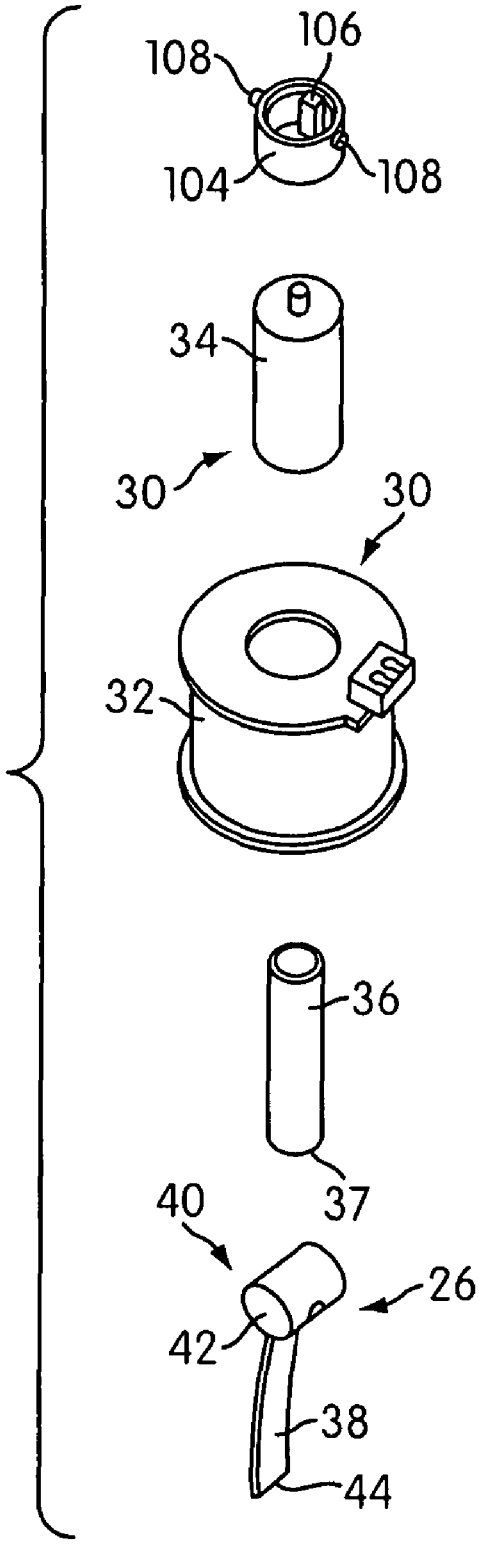
FIG. 3 is an exploded perspective view of a solenoid and driver of the stapler of FIG. 1.

The cylinder 42 of the driver 26 is designed to allow angular misalignment between the plunger 36 and the proximal end 40 of the driver 26. The driver 26 follows the curved passageway 46 as it is driven by the solenoid-driven plunger 36. The cylinder 42 has its longitudinal axis transverse to the longitudinal axis of the plunger 36, as shown in FIG. 3. The plunger 36 has a transverse flat surface 37 that contacts the surface of the cylinder 42. A spring 48 acts upwardly on the driver 26 to bias it continuously in the upward direction U against the flat surface 37 of the plunger 36. This also biases the plunger 26 and core 34 upward.

A safety contact arm 58 is also slidingly received by the body portion 22 of the housing 12 such that it may move in and out of the housing in an orientation that is substantially perpendicular to the bottom surface 20 of magazine 16. The contact arm 58 is biased in an outward position that extends beyond the bottom surface 20 of the magazine 16 by a spring 62. When the contact arm 58 is placed against the workpiece and pressed upward and into the housing 12, the contact arm 58 contacts a switch 64 that defines a portion of an electrical circuit 66 that is located within the housing 12. Contacting the switch 64 allows the switch 64 to be in the "ON" position. Once the switch 64 has been moved to the "ON" position, by moving the contact arm 58 upward with the workpiece, a trigger 70 that is connected to the housing 12 at the handle 14 may be depressed by the user to complete the electrical circuit.

Specifically, the trigger 70 is biased outwardly from the handle 14 by a spring 69. When the trigger 70 is moved against the bias of the spring 69, it moves a switch 71 to the "ON" position.

Figure 12:
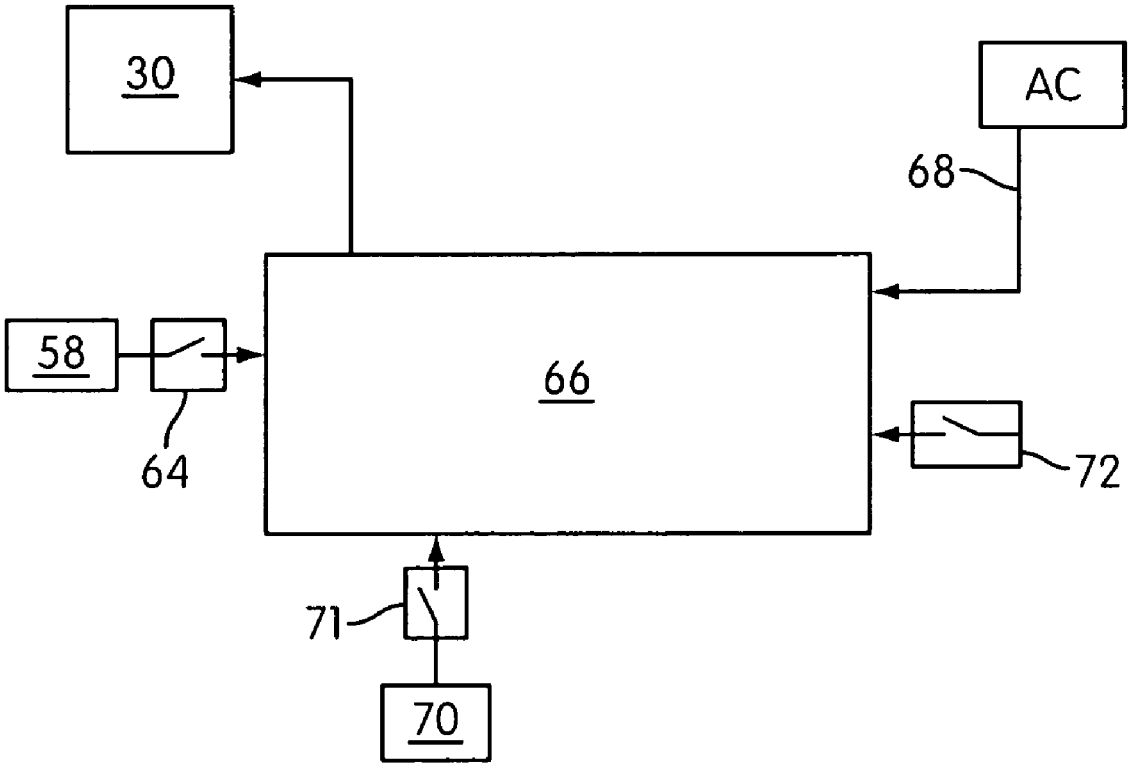
FIG. 12 is a schematic of an electrical circuit of the stapler of FIG. 1.

The electrical circuit 66 permits a single pulse of electrical current to reach the coil 32. A cable 68 is provided to connect the stapler 10 to a source of 110 volt, alternating current electricity via a plug 67. An ON/OFF switch 72 may be provided on the housing 12 to allow the user to turn the stapler "ON" and "OFF." When the stapler 10 is turned "ON," the solenoid 30 may be energized when the electrical circuit 66 within the stapler 10 is completed. When the stapler 10 is turned "OFF," the electrical circuit 66 within the stapler 10 cannot be completed, and the stapler 10 will not operate. When the stapler 10 is turned "ON," the electrical circuit 66 is completed when the contact arm 58 is depressed and switches the switch 64 to the "ON" position, and the trigger 70 is depressed and switches the switch 71 to the "ON" position, preferably in that order. When all three conditions are met, the solenoid 30, more specifically the coil 32, will energize and provide energy to the driver 26 to drive the leading fastener 18 into the workpiece. A schematic of the electrical circuit 66 and its inputs and output is shown in FIG. 12. Of course, the electrical circuit 66 may be designed so that if the trigger 70 is depressed before the contact arm 58 is depressed, the coil 32 of the solenoid 30 will not energize. The illustration shown in FIG. 12 should not be considered to be limiting in any way.

The depth of drive of the fastener 18 may be adjusted by adjusting the position of the core 34 relative to the coil 32 prior to the energizing of the coil 32. That is, by increasing the available stroke length of the core 34, additional power may be provided to the driver 26, and hence the fastener 18. All other things being equal, more power will drive the fastener 18 deeper into the workpiece.

To adjust the core 34 relative to the coil 32, a manually adjustable depth adjuster 74 is provided. The depth adjuster 74 is configured to be movable between a plurality of predefined positions, including a maximum depth of drive position 78, a minimum depth of drive position 80, and at least one intermediate depth of drive position 82. The depth adjuster 74 includes a cam 84 having a cam surface 86 that interacts with the core 34 of the solenoid 30 via a sleeve 104 that is connected to the core 34. The adjuster 74 also includes an adjustment knob 90 that is connected to the cam 84 such that movement of the adjustment knob 90 causes corresponding movement of the cam 84, and a detent mechanism 92 for securing the cam 84 at one of the plurality of the predefined positions. Securing the cam 84 at one of the plurality of predefined positions defines the upper position of the core 34 so as to adjust the length of the axial stroke of the driver 26.

Defining the upper position of the core 34 not only defines the starting position of the driver 26 due to its interaction with the plunger 36 and the core 34, but it also determines the power that will be provided by the coil 32 of the solenoid 30 to the core 34. For example, when the depth adjuster 74 is set at the maximum depth of drive position 78, as shown in FIG. 5, the upper position of the core 34 is such that the core 34 is farthest away from the bottom surface 20 of the magazine 16. Due to the upward bias of the spring 48 on the driver 26, the driver 26 is also the farthest away from the bottom surface of the magazine 20. This also decreases the amount of the core 34 that is positioned within the coil 32 when the coil 32 is energized. Thus, when the coil 32 is energized, the increased movement of the core 34 relative to the coil 32 increases the power provided to the driver 26. At the same time, due to the starting position of the driver 26, the driver 26 will travel through a stroke of a greater distance. Coupling the increased stroke with the added power being provided to the driver 26 allows the driver 26 to impact the fastener 18 with greater energy, which will cause the fastener 18 to penetrate the workpiece at a greater depth.

In contrast, when the depth adjuster 74 is adjusted so that it is in the minimum depth of drive position 80, as shown in FIG. 6, the cam 84 will push the core 34 of the solenoid into the coil 32, which will cause the plunger 36 to push the driver 26 to a position that is closer to the bottom surface 20 of the magazine 16. This position not only moves the driver 26 that much closer to the fastener 18, but it also decreases the amount of power generated by the solenoid 30 when moving the core 34 relative to the coil 32. This combination results in less energy being transferred from the driver 26 to the fastener 18 so that the fastener 18 will not be driven to as great of a depth, as compared to the depth the same fastener 18 may be driven when the depth adjuster 74 is set at the maximum depth of drive position.

The depth adjuster 74 may also be adjusted so that it is in one of the intermediate depth of drive positions 82, as shown in FIG. 7, that is in between the maximum depth of drive position 78 and the minimum depth of drive position 80.

Figure 9:
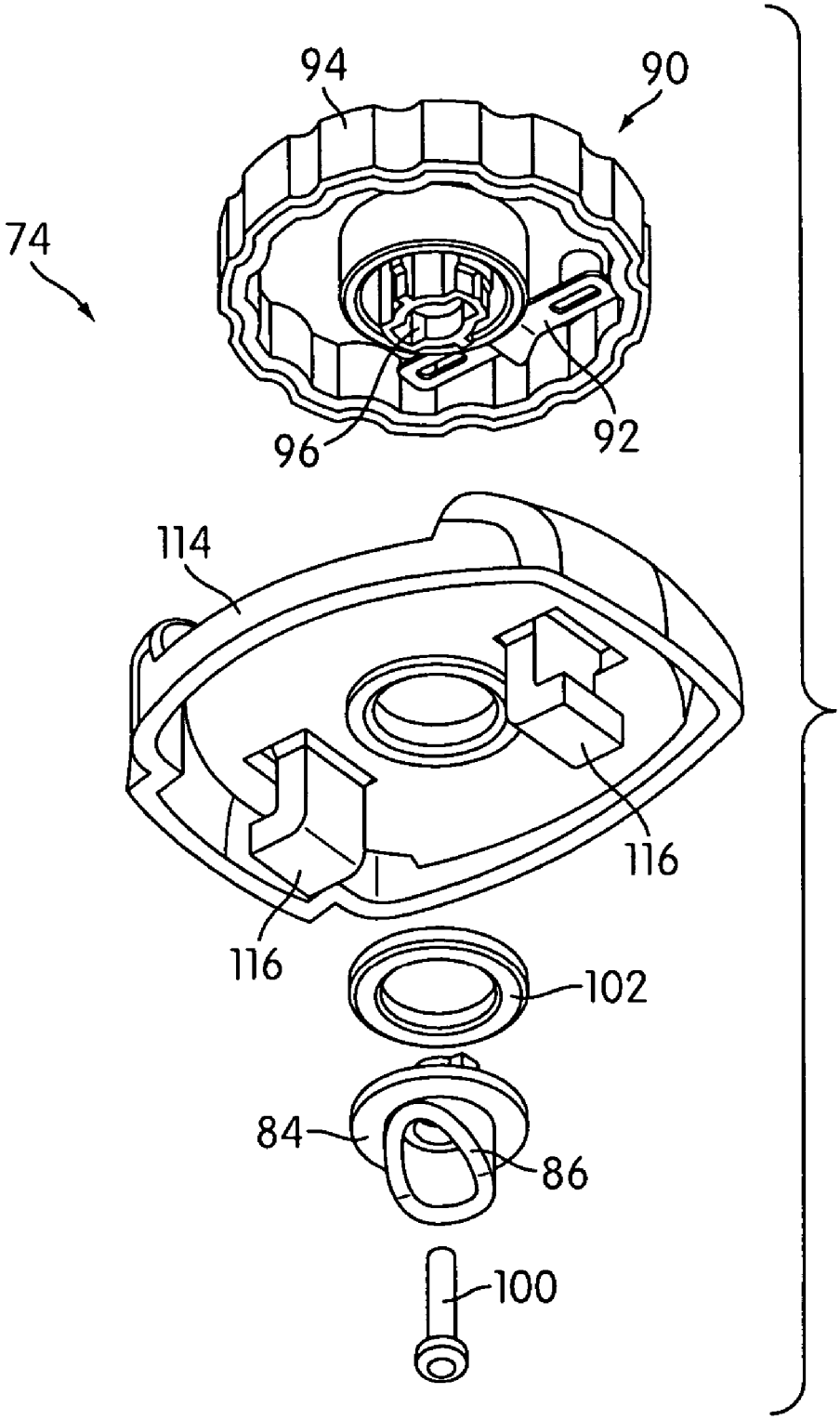
FIG. 9 is a partially exploded bottom perspective view of the adjustable depth adjuster of FIG. 8.
Figure 10:
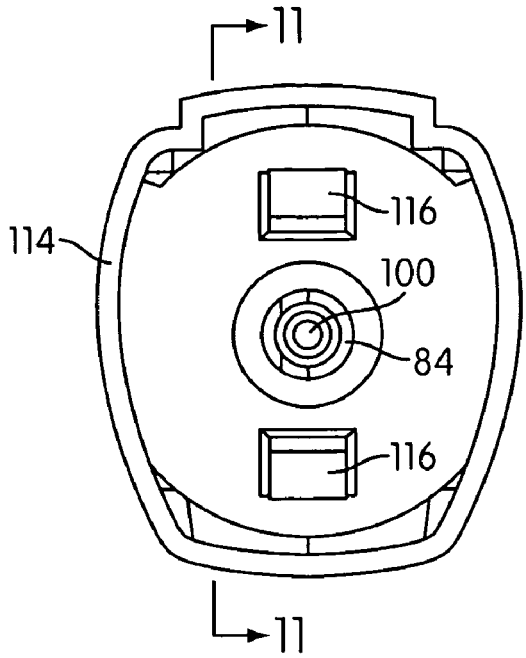
FIG. 10 is a bottom view of the adjustable depth adjuster of FIG. 9.
Figure 11:
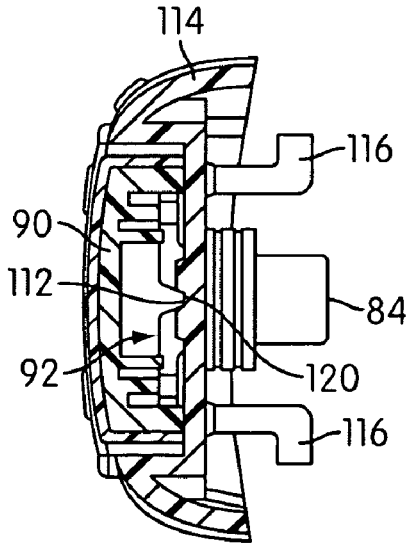
FIG. 11 is a cross-sectional view along line 11-11 in FIG. 10.

The adjustment knob 90 has a disk-shaped body 94 and is configured to be connected to the cam 84. As shown in FIG. 9, the knob 90 includes a lock 96 that extends from the body 94 and is configured to receive a key 98 that is located on the cam 84. Insertion of the key 98 into the lock 96 prevents the cam 84 from rotating relative to the knob 90. A fastener 100 may also be used to fixedly secure the cam 84 to the knob 90. The knob 90 rotates about an axis that is coaxial with the axis of the core 34 of the solenoid 30. Preferably, the cam 84 is formed as a hollow cylinder with a portion of one side of the cylinder cut off at an angle, which defines the cam surface 86 that rotates when the knob 90 is rotated.

As discussed above, the core 34 of the solenoid 30 is provided with the sleeve 104 that is connected to the upper end of the core 34. The sleeve 104 may be connected with any suitable means, such as with an adhesive, a fastener, a weld, or any other way, so long as the sleeve 104 is fixedly connected to the core 34. The sleeve 104 is shaped to receive the cam 84 of the depth adjuster 74. The sleeve 104 includes a cam follower 106 that is configured to contact and follow the cam surface 86 of the cam 84. The sleeve 104 is preferably configured to resist rotation about its axis. This may be done by providing the sleeve 104 with at least one protrusion 108 located on an outer surface of the sleeve 104. In the illustrated embodiment, the sleeve 104 includes a pair of protrusions 108 that are located on opposite sides of the sleeve 104. The protrusions 108 are configured to interact with the ribs 56 provided in the housing 12 such that the protrusions 108 may slide along the ribs 56 in a direction that is parallel with the longitudinal axis LA of the core 34, but may not rotate about the longitudinal axis LA. This allows the sleeve 104 and the core 34 to move along the longitudinal axis LA but resist rotation about the longitudinal axis LA.

Thus, when the adjustment knob 90 is turned to its maximum depth of drive position, as shown in FIG. 5, the cam surface 86 is positioned so that the upwardly biased cam follower 106 in the sleeve 104 moves upwardly to its uppermost high power position. This allows the solenoid 30 to have a maximum core stroke length and to deliver maximum power to the plunger 36, the driver 26 and the leading fastener 18 in the magazine 16. In contrast, when the adjustment knob 90 is turned to its minimum depth of drive position, as shown in FIG. 6, the cam surface 86 is positioned such that the cam follower 106 is pushed downwardly to its lowermost low power position. This position limits the core 34 to the shortest possible stroke length, thereby resulting in the delivery of the lowest possible power to the plunger 36, the driver 26, and the leading fastener 18 in the magazine 16. The adjustment knob 90 may also be turned to at least one intermediate setting, as shown in FIG. 7, so that the core 34 of the solenoid 30 may have a stroke length that is in between its maximum and minimum stroke lengths.

The detent mechanism 92 allows for the different positions of the adjustment knob 90 to be locked in place, so that the position of the cam surface 86, and therefore the cam follower 106 and core 34 may be fixed. Due to the upward bias of the driver 26, the plunger 36, the core 34, the sleeve 104, and the cam follower 106, the cam follower 106 will have the tendency to cause the cam 84 to rotate so that the cam follower 106 will be at its uppermost position. The detent mechanism 92 is designed to provide the cam 84 with adequate resistance to such movement.

Figure 8:
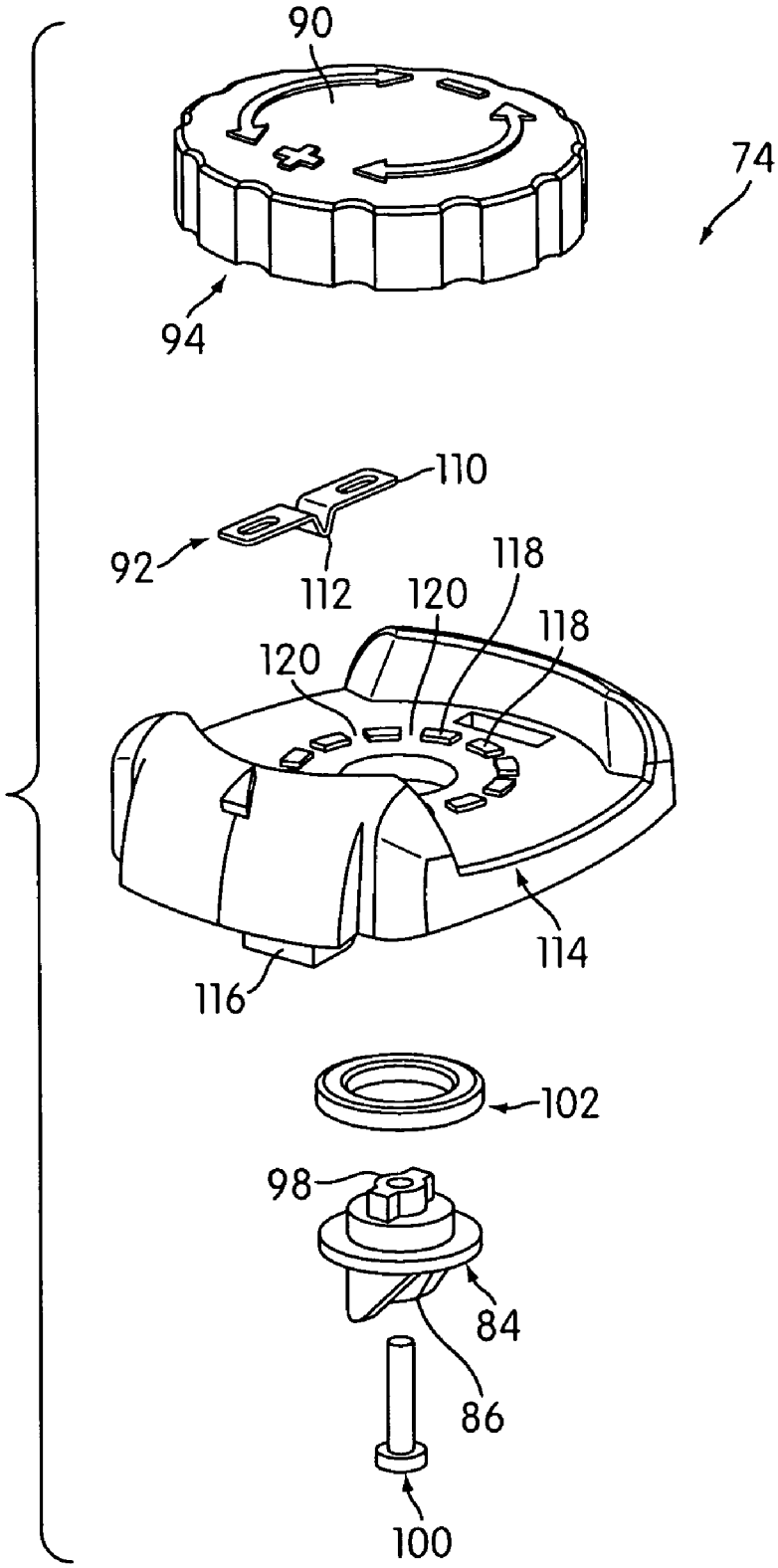
FIG. 8 is an exploded top perspective view of an embodiment of the adjustable depth adjuster.

As shown in FIG. 8, the detent mechanism 92 includes a slip plate 110 that includes a protrusion 112. The detent mechanism 92 may be attached to the adjustment knob 90 or the detent mechanism 92 may be attached to the housing 12, or any structure that is connected to the housing 12. In the embodiment illustrated in the Figures, a cap 114 is connected to the housing 12 via a pair of tabs 116. The cap 114 is provided with a plurality of protrusions 118 that are equally spaced circumferentially from each other so as to define a plurality of recesses 120 therebetween. The plurality of recesses 120 are configured to interact with the detent mechanism 92 so as to provide the plurality of predefined positions that correspond to a plurality of rotational positions of the cam 84 and, hence, the cam surface 86. Of course, the plurality of recesses 120 may be provided in the housing 12 itself and not the cap 114. In this regard, the cap 114 may be considered to be a part of the housing 12. The illustrated embodiment is not intended to be limiting in any way. A washer 102 may be placed between the cam 84 and the cap 114 to provide a smooth rotation of the cam relative to the cap 114 when the knob 90 is rotated by the user.

By providing this arrangement of the recesses 120 and the detent mechanism 92, movement of the knob 90 by the user provides the user with a tactile, and possibly an audio (e.g., a clicking noise), feedback as the detent mechanism 92 moves from one recess to another recess. Thus, the user will actually be able to feel the plurality of predefined positions as the knob 90 is moved. This provides the user with a quick and easy way to incrementally change the depth of drive of the staple. It also provides the user with an easy way to repeat a depth of drive, even when the depth of drive has been changed in between uses.

In another embodiment, the detent mechanism 92 is connected to the housing 12, and the plurality of recesses 120 are provided on the adjustment knob 90. In yet another embodiment, the detent mechanism 92 is designed so that it does not interact with a plurality of recesses to lock the cam 84 into one of the plurality of predefined positions, but instead provides enough friction so that the cam 84 cannot rotate as a result of the upward bias of the cam follower 106, yet can be rotated by the user by rotating the adjustment knob 90.

In another embodiment, the detent mechanism 92 includes a plurality of protrusions and is provided on one of the adjustment knob 90 and the housing 12 (or cap 114), and a single recess is provided on the other of the adjustment knob 90 and the housing 12 (or cap 114). The illustrated embodiment is not intended to be limiting in any way.

In operation, the user loads a plurality of selected fasteners 18 into the magazine 16 and closes the magazine 16 so that the pusher 28 engages the rearmost fastener and pushes the leading fastener into the drive track 25. The user then plugs the plug 67 of the stapler 10 into a standard electric outlet, and switches the ON/OFF switch 72 to the "ON" position. The stapler 10 is ready for use. The user selects the desired depth of drive with the adjustment knob 90 by rotating the knob 90 relative to the housing 12 to the desired predefined position. The user then locates the stapler 10 on the desired located of the workpiece, presses the stapler 10 against the workpiece so as to move the safety contact arm 58 upward and into the housing 12, and depresses the trigger 70. The electrical circuit 66 within the stapler 10 energizes the coil 32 of the solenoid 30 such that an electromagnetic field is generated. The electromagnetic field accelerates the core 34 of the solenoid 30, and hence the plunger 36 and the driver 26, against the bias of the spring 48, thereby causing the driver 26 to drive the leading fastener 18 that is in the drive track 25 out of the stapler 10 and into the workpiece. If the user wishes to change the depth of drive of the next fastener 18, the adjustment knob 90 may be rotated to another of the plurality of predefined positions, either prior to or after placing the contact arm 58 of the stapler 10 on the workpiece, but before depressing the trigger 70.

The foregoing embodiments have been provided to illustrate the structural and functional principles of the present invention, and are not intended to be limiting. To the contrary, the present invention is intended to encompass all modifications, alterations and substitutions within the spirit and scope of the appended claims.

What is claimed is:

1. An electromagnetic stapler comprising:

a housing;

a driver within the housing for driving fasteners into a workpiece;

a magazine for feeding the fasteners to be driven by the driver;

a solenoid for providing power to the driver, the solenoid having a coil, and a core, the core being operatively connected to the driver;

a manually adjustable depth adjuster for adjusting a depth of drive of the fasteners, the depth adjuster being movable between a plurality of predefined positions, including a maximum depth of drive position, a minimum depth of drive position, and at least one intermediate depth of drive position, the depth adjuster comprising:

a cam having a cam surface that interacts with the core of the solenoid so as to define a selected upper position of the core, wherein the cam is movable between (a) a first position in which the upper position of the core is defined at an uppermost position, (b) at least one second position in which the upper position of the core is defined at at least one middle position, and (c) a third position in which the upper position of the core is defined at a lowermost position;

a rotatable adjustment knob operatively connected to the cam such that movement of the adjustment knob causes corresponding movement of the cam, wherein forceable engagement of the core with the cam surface causes the core to apply a camming force on the cam surface that biases the cam for movement in a rotational direction toward the first position; and a detent mechanism operatively connected with the adjustment knob and countering the camming force applied by the core on the cam surface to prevent movement of the cam from the at least one second position toward the first position, the detent mechanism thus locking the cam at the selected position to thereby define the upper position of the core so as to establish the length of an axial stroke of the core and the driver.

2. An electromagnetic stapler according to claim 1, wherein the detent mechanism is provided on the adjustment knob.

3. An electromagnetic stapler according to claim 1, wherein the detent mechanism is provided on the housing.

4. An electromagnetic stapler according to claim 1, further comprising a plurality of recesses that are arranged to define the plurality of predefined positions, the plurality of recesses being configured to interact with the detent mechanism so as to lock the cam at one of the selected positions.

5. An electromagnetic stapler according to claim 4, wherein the detent mechanism comprises a slip plate, the slip plate forming a protrusion such that the protrusion may exit out of a first recess and into a second recess when the adjustment knob is moved.

6. An electromagnetic stapler according to claim 5, wherein movement of the adjustment knob provides a tactile feedback to a user when the protrusion exits out of the first recess and into the second recess.

7. An electromagnetic stapler according to claim 5, wherein the slip plate is connected to the housing.

8. An electromagnetic stapler according to claim 5, wherein the slip plate is connected to the adjustment knob.

9. An electromagnetic stapler according to claim 1, wherein the power of the driver increases with an increase in the axial stroke of the core, thereby increasing the depth of drive of the fasteners.

10. An electromagnetic stapler according to claim 1, further comprising a safety contact arm and a trigger, the contact arm and trigger being connected to an electrical circuit that provides electricity to the solenoid, wherein the circuit is arranged to provide the electricity to the solenoid only if the contact arm and the trigger have been actuated.

11. An electromagnetic stapler according to claim 10, wherein the circuit is arranged to provide the electricity to the solenoid only if the contact arm is actuated when the trigger is actuated.

12. A manually adjustable depth adjuster for adjusting a depth of drive of a fastener using an electromagnetic stapler having a housing, a driver, and a solenoid for providing power to the driver, the depth adjuster comprising:

a cam having a cam surface that interacts with a core of the solenoid so as to define a selected upper position of the core, wherein the cam is movable between (a) a first position in which the upper position of the core is defined at an uppermost position, (b) at least one second position in which the upper position of the core is defined at at least one middle position, and (c) a third position in which the upper position of the core is defined at a lowermost position;

a rotatable adjustment knob operatively connected to the cam such that movement of the adjustment knob causes corresponding movement of the cam, wherein forceable engagement of the core with the cam surface causes the core to apply a camming force on the cam surface that biases the cam for movement in a rotational direction toward the first position; and a detent mechanism operatively connected with the adjustment knob and countering the camming force applied by the core on the cam surface to prevent movement of the cam from the at least one second position toward the first position, the detent mechanism thus locking the cam at the selected position to thereby define the upper position of the core so as to establish the length of an axial stroke of the core and the driver.

13. A manually adjustable depth adjuster according to claim 12, wherein the detent mechanism is provided on the adjustment knob.

14. A manually adjustable depth adjuster according to claim 12, wherein the detent mechanism is provided on the housing.

15. A manually adjustable depth adjuster according to claim 12, further comprising a plurality of recesses that are arranged to define the plurality of predefined positions, the plurality of recesses being configured to interact with the detent mechanism so as to lock the cam at one of the selected positions.

16. A manually adjustable depth adjuster according to claim 15, wherein the detent mechanism comprises a slip plate, the slip plate forming a protrusion such that the protrusion may exit out of a first recess and into a second recess when the adjustment knob is moved.

17. A manually adjustable depth adjuster according to claim 16, wherein movement of the adjustment knob provides a tactile feedback to a user when the protrusion exits out of the first recess and into the second recess.

18. A manually adjustable depth adjuster according to claim 16, wherein the slip plate is connected to the housing.

19. A manually adjustable depth adjuster according to claim 16, wherein the slip plate is connected to the adjustment knob.

20. An electromagnetic stapler according to claim 1, wherein the driver drives fasteners into the workpiece at a selected depth corresponding to one of the plurality of predefined positions during use until the rotatable adjustment knob is rotated to another of the plurality of predefined positions.

21. An electromagnetic stapler according to claim 12, wherein the driver drives fasteners into the workpiece at a selected depth corresponding to one of the plurality of predefined positions during use until the rotatable adjustment knob is rotated to another of the plurality of predefined positions.

* * * * *